US007945990B2

(12) United States Patent
Gabric et al.

(10) Patent No.: US 7,945,990 B2
(45) Date of Patent: May 24, 2011

(54) VACUUM HOSE STORAGE SYSTEM

(75) Inventors: Andrew L. Gabric, Louisville, OH (US); Shawn C. Metz, Louisville, OH (US); Darrell V. Nieschwitz, Louisville, OH (US); James F. Smith, Louisville, OH (US)

(73) Assignee: H-P Products, Inc., Louisville, OH (US)

( * ) Notice: Subject to any disclaimer, the term of this patent is extended or adjusted under 35 U.S.C. 154(b) by 605 days.

(21) Appl. No.: 12/151,174

(22) Filed: May 5, 2008

(65) Prior Publication Data

US 2009/0188072 A1 Jul. 30, 2009

Related U.S. Application Data

(60) Provisional application No. 61/062,724, filed on Jan. 29, 2008.

(51) Int. Cl.
*A47L 9/00* (2006.01)

(52) U.S. Cl. ..... 15/323; 15/312.2; 15/315

(58) Field of Classification Search ..... 15/323, 15/301, 257.01, 312.2, 327, 327.2, 314, 315
See application file for complete search history.

(56) References Cited

U.S. PATENT DOCUMENTS

| | | | | |
|---|---|---|---|---|
| 2,943,698 | A | | 7/1960 | Bishop |
| 2,953,806 | A | | 9/1960 | Walker |
| 3,173,164 | A | | 3/1965 | Congdon |
| 3,520,725 | A | | 7/1970 | Hamrick |
| 3,568,240 | A | | 3/1971 | Hamrick |
| 3,593,363 | A | | 7/1971 | Hamrick |
| 3,911,944 | A | * | 10/1975 | Hukuba et al. ..... 137/355.2 |
| 3,958,297 | A | * | 5/1976 | Hukuba et al. ..... 15/315 |
| 3,977,037 | A | | 8/1976 | Miyake et al. |
| 3,977,038 | A | * | 8/1976 | Hukuba et al. ..... 15/339 |
| 4,050,113 | A | * | 9/1977 | Wright et al. ..... 15/315 |
| 4,064,355 | A | | 12/1977 | Neroni et al. |
| 4,133,347 | A | | 1/1979 | Mercer |
| 4,133,972 | A | | 1/1979 | Andersson et al. |
| 4,194,081 | A | | 3/1980 | Medford et al. |
| 4,368,348 | A | | 1/1983 | Eichelberger et al. |
| 4,688,292 | A | | 8/1987 | Schmiegel |
| 5,119,843 | A | | 6/1992 | Keenan |
| 5,222,906 | A | | 6/1993 | Lundstrom |

(Continued)

FOREIGN PATENT DOCUMENTS

| | | |
|---|---|---|
| EP | 0963939 | 12/1999 |

*Primary Examiner* — Dung Van Nguyen
(74) *Attorney, Agent, or Firm* — Sand & Sebolt

(57) ABSTRACT

A vacuum hose storage system includes a housing which is mounted in a storage area of a dwelling or vehicle and connected to a vacuum source. A length of flexible, expandable cleaning hose is mounted in a looped fashion about a plurality of spaced rollers rotatably mounted within the housing. A handle is attached to one end of the hose and is seated in a cradle formed in the housing when the hose is in a fully retracted position within the housing. The cradle is mounted in the housing and receives the open end of the hose when not in use and enables other vacuum tubes in the structure to be operational without shutting off the vacuum to the stored hose. An ON/OFF switch is located in the cradle for controlling the vacuum source and is actuated when the handle is placed in or removed from the cradle. The hose has an internal helical spring which biases the hose toward a retracted position about the spaced rollers within the housing.

23 Claims, 12 Drawing Sheets

U.S. PATENT DOCUMENTS 5,349,146 A * 9/1994 Radabaugh ..... 200/61.6
5,430,978 A 7/1995 Kohler
5,526,842 A 6/1996 Christensen
5,740,581 A 4/1998 Harrelson, II
6,058,560 A 5/2000 Gab et al.
6,120,615 A 9/2000 Fletcher
6,182,327 B1 2/2001 Gosselin
6,427,284 B1 8/2002 Harrelson, II et al.
6,560,816 B1 5/2003 Harrelson, II
6,817,058 B1 11/2004 Harrelson, II
6,948,527 B2 9/2005 Ragner et al.
7,010,829 B2 3/2006 Harman et al.
7,363,679 B2 * 4/2008 Zimmerle et al. ..... 15/315
2002/0013974 A1 2/2002 Gibson et al.
2006/0070679 A1 4/2006 Ragner
2008/0092323 A1 * 4/2008 Smith et al. ..... 15/314

* cited by examiner $L_{TOT} = \Sigma L + \frac{1}{2} W \pi D$ $L_{TOT}$ = TOTAL LENGTH OF HOSE INSIDE

W = # OF WHEELS

VACUUM HOSE STORAGE SYSTEM

CROSS REFERENCE TO RELATED APPLICATIONS

This application claims priority from U.S. Provisional Application Ser. No. 61/062,724 filed Jan. 29, 2008; the disclosure of which is incorporated herein by reference.

BACKGROUND OF THE INVENTION

1. Technical Field

The invention relates to vacuum cleaning systems, and in particular to a storage system connected to a vacuum source for storing an extendable length of hose in a retracted condition within a storage housing. More particularly, the invention relates to a small, compact storage system adapted to be mounted in a concealed area within a home, such as in a kitchen cabinet, which contains a sufficient length of an expandable hose for ease of cleanup of the adjacent room.

2. Background Information

Central vacuum systems for home and commercial use have been used for many years, examples of which are shown in U.S. Pat. Nos. 2,943,698 and 3,173,164. These systems usually are comprised of a main vacuum source which is usually mounted in the basement or other location in the structure or closely adjacent thereto. The vacuum source is connected to various outlet locations in the structure by tubing which terminate in valves mounted in the wall into which one end of a length of cleaning hose is removably connected for cleaning an area adjacent the wall valve. These wall or hose end valves usually include some type of closure lid, which seals the hose receiving opening in the valve enabling another of the valves to be operational within the structure. Many of these valves are provided with electrical contacts or switches which energize the main vacuum source. The vacuum hose also may be provided with a pair of electric conductors for actuating the central vacuum source by a switch on the handle, such as shown in U.S. Pat. Nos. 4,064,355, 4,133,972, 4,194,081 and 4,368,348.

When using the cleaning system, the homeowner will generally have a single length of cleaning hose with various attachments which are stored in a closet or other location requiring the hose to be moved from room to room to be connected to the appropriate wall valve for cleaning the area adjacent the valve location. In many situations, this is less convenient than desired since the homeowner must continually go to a remote location to retrieve the cleaning attachments and hose for use in a particular room and then return the cleaning attachment, cleaning wand and hose to the closet for final storage. Also, these storage areas become cluttered and occupy needed space in other closets of the house.

Some central vacuum cleaning systems attempt to solve some of these storage problems by having the hose retractably inserted into the vacuum supply duct when not in use such as shown in U.S. Pat. Nos. 2,953,806, 3,593,363, 5,526,842 and 7,010,829. In another attempt to solve this storage problem in a central cleaning system, an in-wall storage cabinet was developed and shown in U.S. Pat. No. 5,740,581. However, the storage arrangement of this latter system requires the use of a power-driven mechanism for retracting the hose when not in use. Although this may perform satisfactory for its intended purpose, it is a more costly installation than may be desired by many homeowners and it requires the hose to be dedicated to a single vacuum source. This prevents the same vacuum source to be energized for supplying a vacuum to other wall valves in the structure. Also, these units may tend to be weak because their size is very limited, and in addition, their dirt capacity may also be limited.

Due to the need to retrieve the vacuum hose from a storage area and connected to an in-wall vacuum supply valve, many homeowners will not use the system for small cleanups, such as small quantities of dirt or other debris such as spillages in a kitchen or the like, and will use a manual broom. These types of cleanups usually are required in a kitchen, workroom or laundry area, but do not receive the homeowner's immediate attention due to the need of retrieving the relative long length of hose from the storage area and connecting it to a central vacuum system. Afterwhich the hose has to be disconnected from the wall valve and returned to the storage area.

Thus, the need exists for an improved hose storage system contained in a small, compact hose storage housing which can be located inside of a larger storage cabinet, such as a kitchen sink cabinet or adjacent cabinet, which facilitates the use of the vacuum cleaning equipment in a relatively simple and convenient manner, and most importantly enables a sufficient length of cleaning hose to be easily removed from and returned to the storage housing when not in use, and which can enable other vacuum outlets in the structure to be active, that is, have the vacuum source supplied to the storage housing of the present invention and to other vacuum outlets from a single central vacuum supply source, by providing a closure for an open end of the cleaning hose when not is use and stored in the housing.

BRIEF SUMMARY OF THE INVENTION

The present invention provides a vacuum hose storage system having a compact hose storage housing for storing the cleaning hose, wherein the housing preferably is mounted in a larger storage area or cabinet which is connected to a vacuum source tube, which tube can extend from a main central vacuum source or from a self-contained vacuum source located within or adjacent the hose storage housing.

Another feature of the invention is to provide such a hose storage system in which the hose is permanently connected to a vacuum source tube by providing a sealing device at an open end of the hose handle which enables a central vacuum source to be active and provide a source of vacuum at other wall valves throughout the structure, enabling another hose to be used by the homeowner at one or more of these other valves if desired.

Still another feature of the invention is to provide such a hose storage system in which the hose when not in use is inserted into a pivotally mounted cradle which automatically actuates a switch to turn off the vacuum source and which seals the end of the hose to enable a central vacuum source to be active and provide a source of vacuum at other wall valves throughout the structure.

A further feature of the present invention is to provide the hose storage housing with a plurality of rollers attached in a spaced relationship between the walls of the housing within the storage compartment around which the hose is placed in a looped fashion preventing it from becoming tangled within the housing, and which enables the hose to be easily grasped and pulled from the housing by expanding the hose from a retracted to an extended position.

Another aspect of the invention is to form the rollers with a concave outer circumference to ensure that the hose during expansion and contraction remains in proper alignment within the storage housing thereby reducing friction during expansion and contraction of the hose.

Still another aspect of the present invention is to provide a sealing device for an open end of the hose handle when the handle is mounted in a storage cradle, which sealing device can have various configurations for sealing the open end of the handle while the vacuum supply is energized, and in which an ON/OFF switch can be mounted in the support cradle to turn the vacuum power supply ON and OFF automatically upon placing the handle in the cradle.

Another aspect is to provide the hose with an expansion ratio of 5 to 1 thereby enabling a long useable length of hose to be obtained from a relatively short contracted length of hose easily stored in a small storage area.

A further feature is to provide a vacuum storage system in which one or more drive belts may extend between the hose storage rollers to assist in the uniform expansion and contraction of the hose as it is pulled from or retracted back into the housing by synchronizing the rotational movement of the rollers.

Still another feature of the invention is to provide a small compact storage housing preferably mounted within an outer cabinet which stores a maximum length of hose in a minimum amount of storage space within the housing whereby the hose end is easily removed from a storage cradle which upon removal will automatically turn the vacuum source ON and when returned to cradle will automatically turn the vacuum source OFF, in which a maximum length of hose can be stored and removed from a minimum storage area, and in which the vacuum source can be connected at various locations in the storage housing and connected to a remotely located central vacuum source or to a dedicated source of vacuum adjacent the hose storage housing.

Another aspect is to use a neutrally biased hose or an expansion biased hose which relies upon the retraction force created by the vacuum to assist in retracting the hose back into the housing after use eliminating the use of a spring biased retraction type of hose.

Still another feature of the invention is to use a switched hose for actuating the vacuum source by providing an ON/OFF switch on the wand or handle which is connected to the vacuum source motor via electrical conductors extending through the hose.

A further feature is to provide a type of ratchet mechanism on the hose storage rollers which will lock the rollers in position upon pulling the hose from within the storage housing which relieves the biased retraction force on the hose avoiding the user having to continually apply a force to the hose when in use to prevent it from being pulled back into the housing.

A still further feature is to provide a high voltage source (120V or 240V) to a power driven brush-type of cleaning attachment mounted on the end of the hose and connected to the remote source of voltage by electrical conductors extending through the hose to enhance the cleaning ability of the vacuum cleaning system.

These features and advantages are obtained by the vacuum hose storage system of the present invention, the general nature of which may be stated as including a housing or cabinet forming an internal storage compartment; a plurality of guide wheels mounted within the storage compartment; a length of hose extendable between a retracted position in the storage compartment and an extended position extending from said storage compartment, wherein the hose has a first end adapted to be connected to a vacuum source and a second end, with the hose extending in a looped fashion about the guide wheels when in the retracted and extended positions; a handle attached to the second end of the hose; a cradle for holding the handle in a stored position; a switch for turning the vacuum source ON and OFF when the handle is placed in the cradle; and a biasing device connected to the hose exerting a retracting force on the hose when in an extended position.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
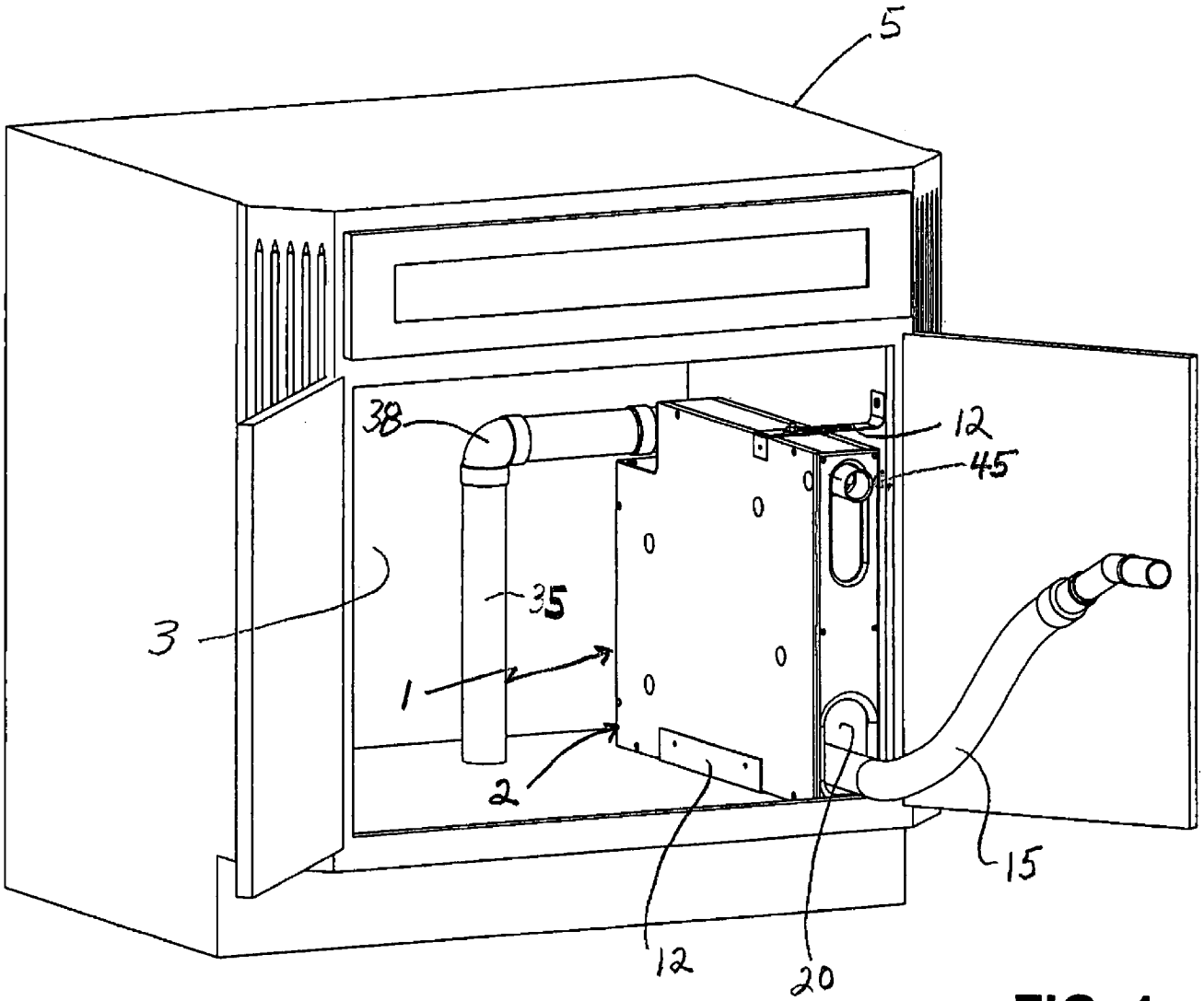
FIG. 1 is a diagrammatic perspective view showing the vacuum hose storage system mounted within an outer storage cabinet and the hose in a partially extended position.

The improved hose storage system of the present invention is indicated generally at 1, and includes a storage housing 2 which is shown in FIG. 1 mounted within the interior 3 of a larger cabinet 5. Storage cabinet 5 preferably is of the type found in most kitchens, laundry rooms or work rooms. Hose storage system 1 is shown removed from cabinet 5 in FIG. 2.

Figure 3:
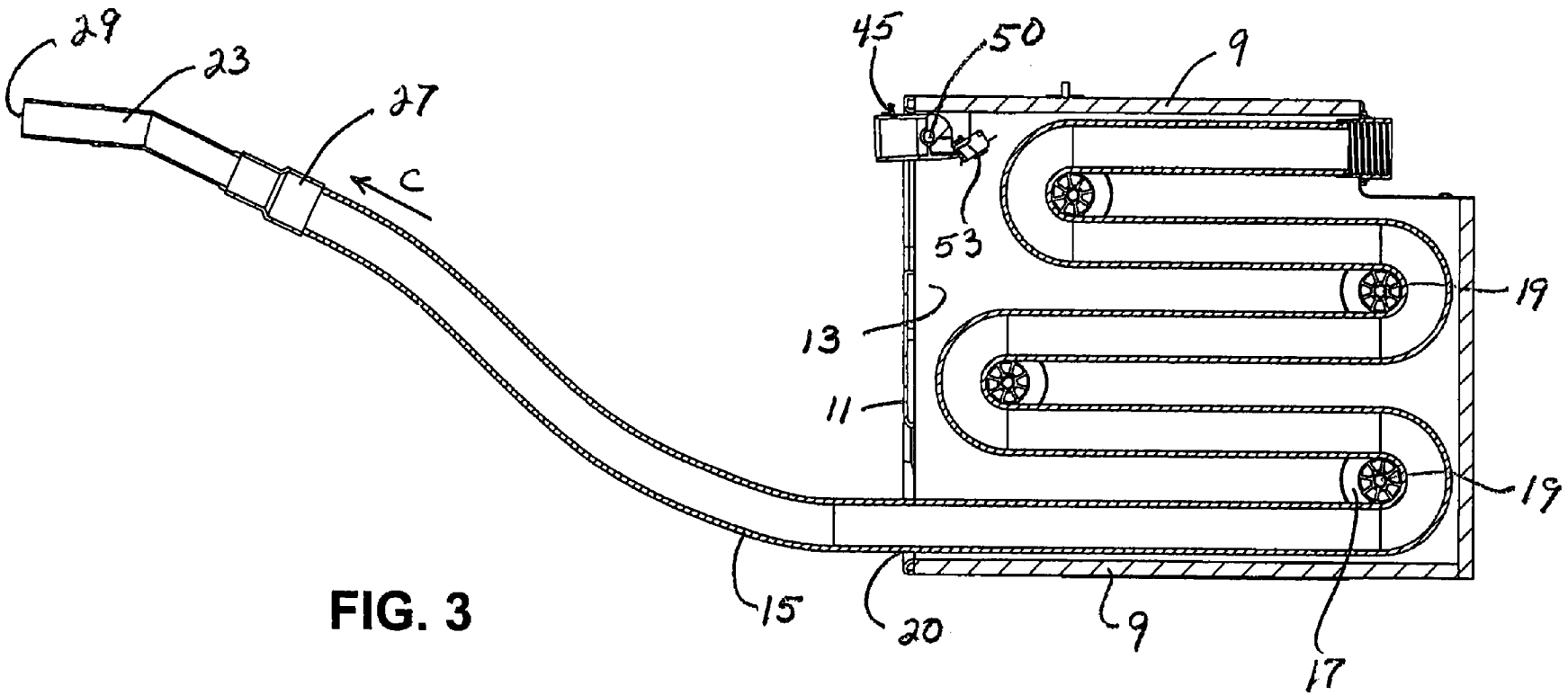
FIG. 3 is a diagrammatic side sectional view of the storage housing as shown in FIG. 2 with the hose in an extended position and the handle removed from the supporting cradle.

Housing 2 preferably has a parallelepiped configuration with opposed side walls 7, opposed top and bottom walls 9 and opposed back wall 10 and front wall 11 which form a hollow interior storage compartment 13 (FIG. 3). In the preferred embodiment, housing 2 will have a length between back and front walls 10 and 11 of twenty and one half inches, a height between top and bottom walls 9 of seventeen inches, and a thickness between side walls 7 of three and one quarter inches, providing a compact structure easily accommodated within the interior of various types of outer cabinets 5. One or more brackets 12 may be used to secure housing 2 within outer cabinet 5 as shown in FIG. 1.

Figure 6:
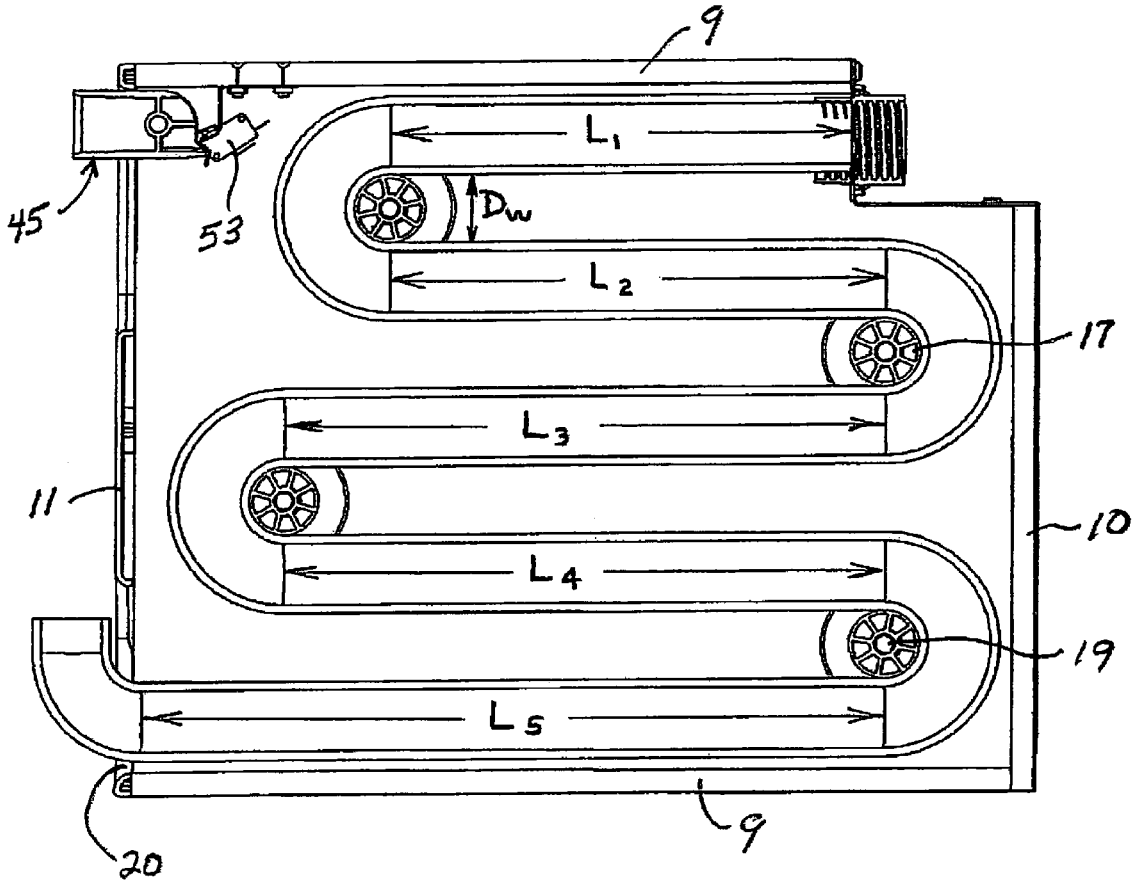
FIG. 6 is a fragmentary side view showing the hose in a fully retracted stored position within the storage housing.
Figure 8:
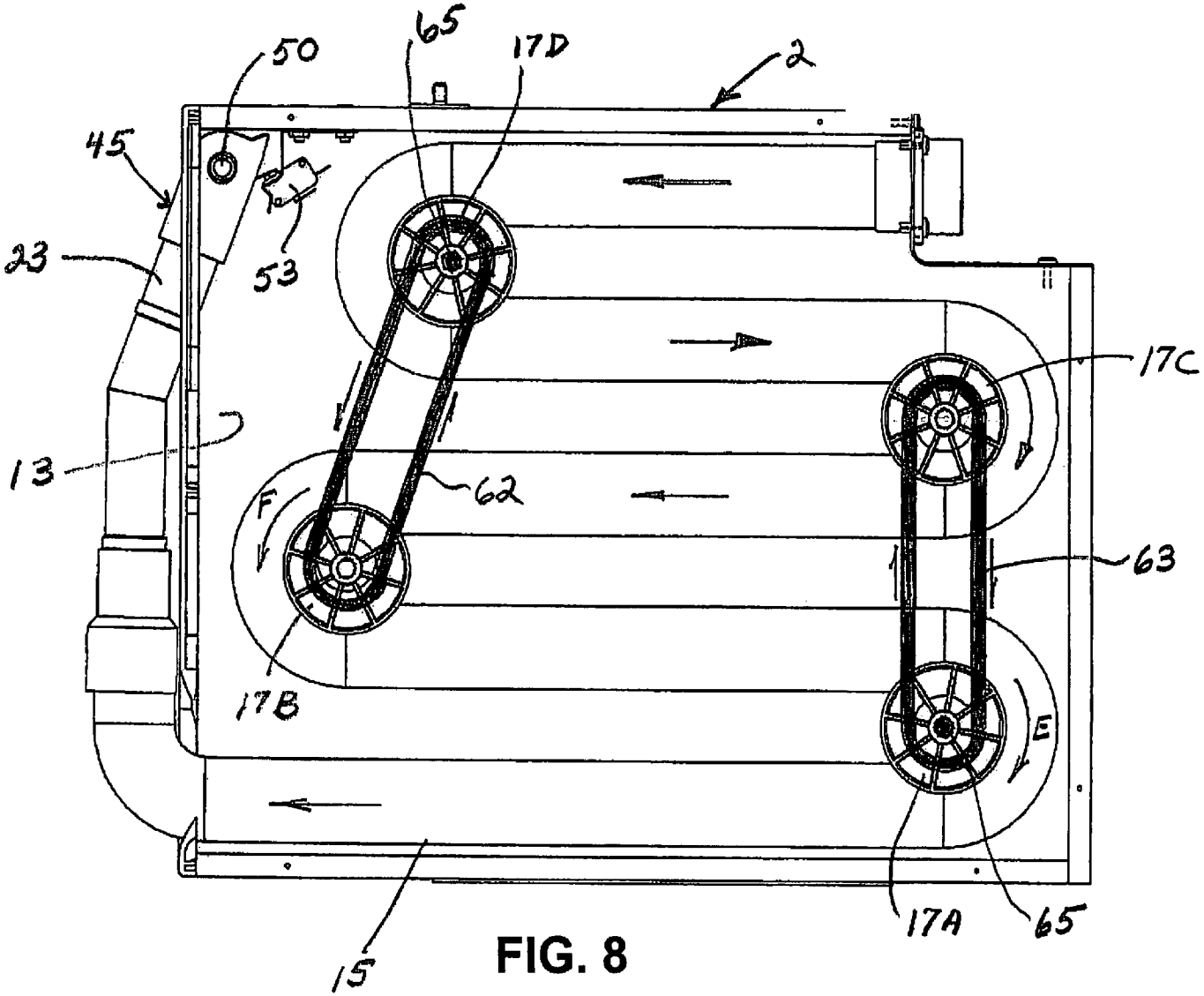
FIG. 8 is a side elevational view with the side wall of the housing removed showing a modified embodiment wherein a pair of drive belts assist in extending and retracting the hose into and out of the housing.
Figure 12:
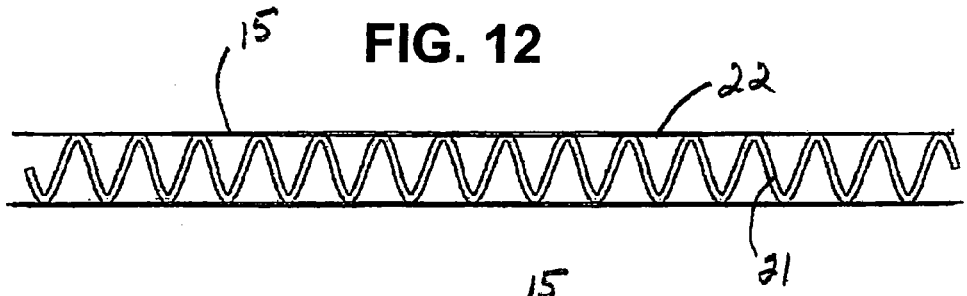
FIG. 12 is a diagrammatic cut-away view of the hose of FIG. 13 in an expanded position.
Figure 13:
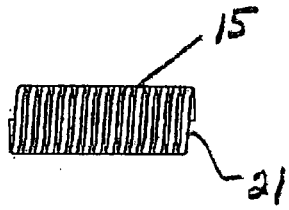
FIG. 13 is a diagrammatic perspective view of a portion of the hose of FIG. 12 in a collapsed position.

In accordance with one of the features of the invention, an extendable hose 15 is mounted in a looped fashion about a plurality of guide rollers 17 which are rotatably mounted within housing 2 on shafts 19, which preferably extend between and are mounted on spaced side walls 7. In the preferred embodiment shown in FIG. 3, four rollers 17 are provided which form for five loops in hose 15. Hose 15 preferably is a type of expandable hose as shown in FIGS. 12 and 13 which includes an internal helical spring 21 which is encased in the outer layer of material 22. Hose 15 is pulled outwardly from housing 2 through a front wall opening 20 and extends from a collapsed position as shown in FIGS. 6 and 8 to a stretched or expanded position of FIG. 3. This will tension spring 21 which then biases the hose towards the collapsed or retracted position of FIGS. 2 and 6 when the outward pulling force exerted thereon is released. The looped arrangement of hose 15 about rollers 17 as shown in FIGS. 3 and 6, enables a relatively large length of hose 15 to be stored within compartment 13 without becoming entangled while providing a sufficient length of hose when pulled therefrom as shown in FIG. 3 to perform cleanup throughout a room in which cabinet 5 is located. The preferred hose 15 will have an elongated factor of 5, that is, if the hose has a collapsed length of eight feet and it has an extended length of forty feet. If desired, hose 15 can be a neutrally biased hose or an expansion biased hose, which types rely solely on the vacuum source to retract it back into the housing.

In the preferred embodiment, hose 15 in a collapsed position as shown in FIG. 6 will have a length of 8 feet, and when stretched out with a 5 to 1 ratio will have a length of approximately 40 feet. When in this fully stretched out position, approximately 8 feet will remain in storage compartment 13 about rollers 17 providing approximately 32 feet of hose extending from housing 2 for use in cleaning up an area about outer storage cabinet 5. However, these lengths can change without affecting the concept of the invention.

Figure 17:
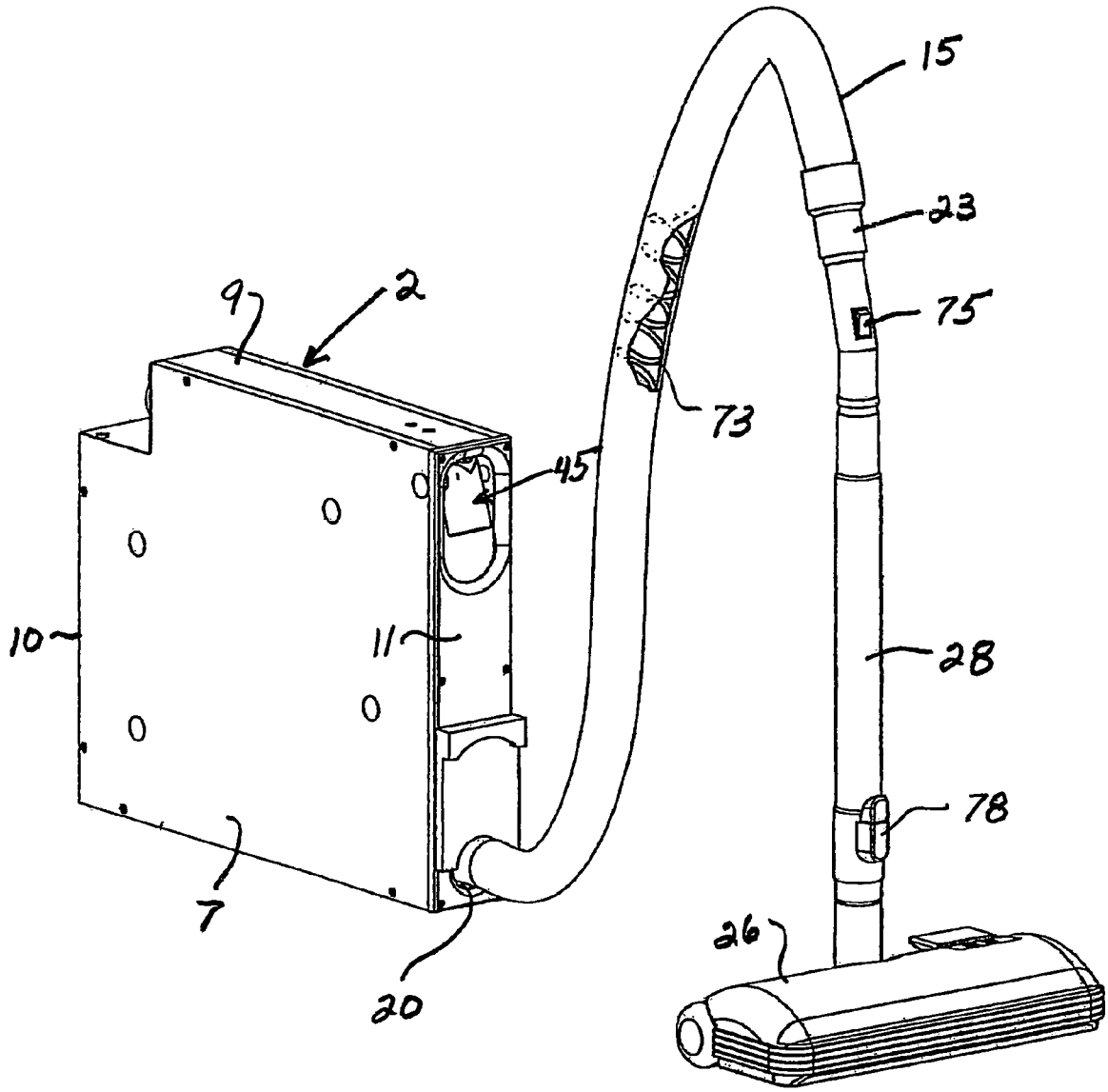
FIG. 17 is a perspective view of another embodiment of the hose storage system of the present invention.

A handle 23 is attached to the distal open end 25 of hose 15 by a connector 27 (FIG. 3). Handle 23 is a rigid tubular member formed of plastic or metal and will have an open end 29 through which dirt enters the hose interior. If desired, a cleaning attachment such as a rotary power driven brush 26 as shown in FIG. 17 could be attached to a wand 28 which in turn is attached to the open end of handle 23. However, for many of the types of cleanups for which hose 15 is intended to be used, a separate attachment is generally not required.

Figure 7:
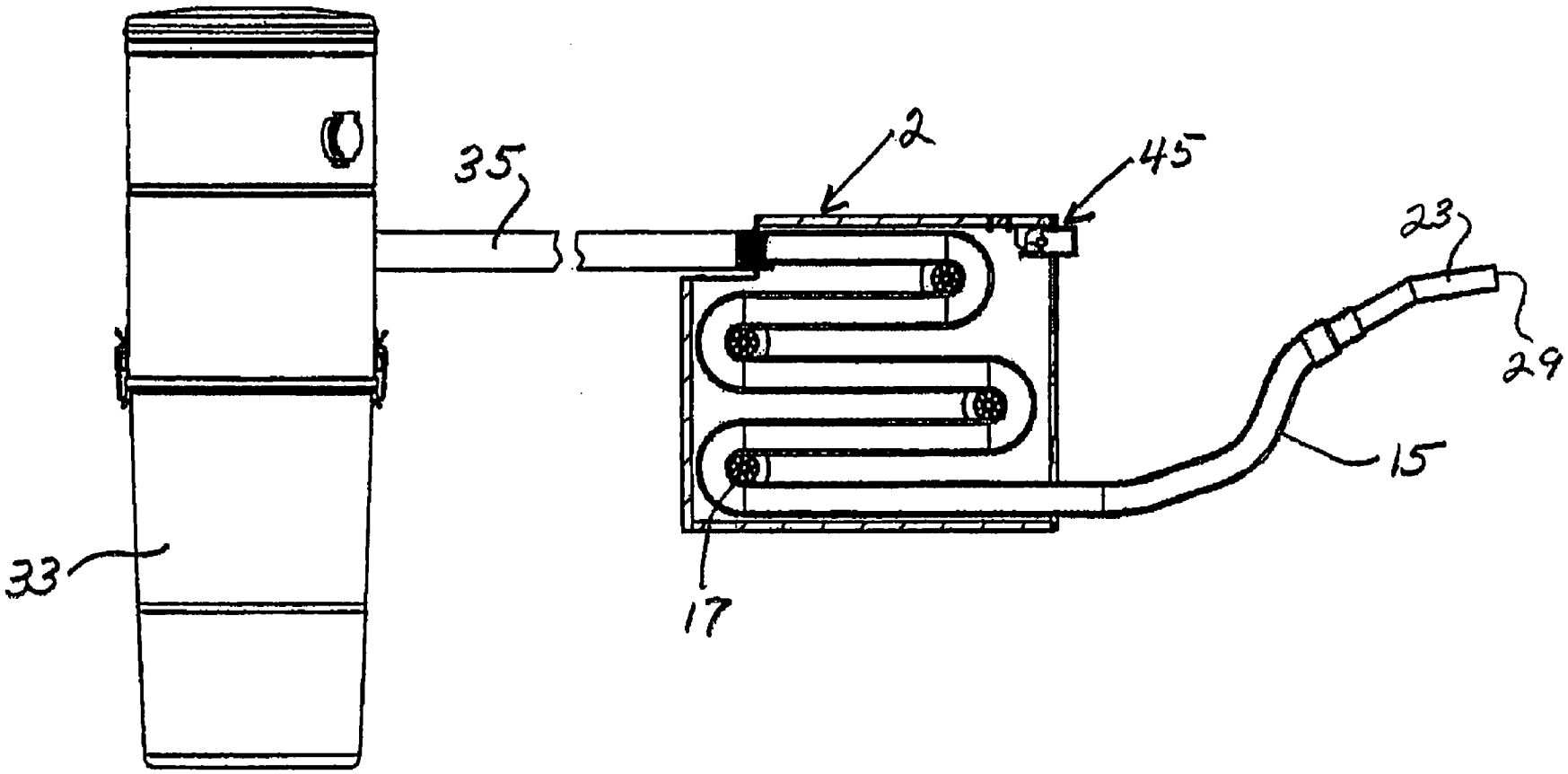
FIG. 7 is a diagrammatic view of the hose storage housing shown in section and the hose in a partially extended position connected to a remote central vacuum cleaning unit.

A vacuum source such as a central vacuum cleaning unit 33, as shown in FIG. 7, generally is mounted in a basement, attic etc. of the building, can be connected directly to housing 2 by a length of tubing 35 or with an elbow pipe 38 as shown in FIG. 1. A vacuum source such as a self-contained vacuum producing motor 32, can be mounted within a separate housing 31 (FIG. 15) that can be attached to a side wall 7 of housing 2 or mounted adjacent thereto and pneumatically connected to hose 15 by a section of tubing 30.

Figure 16:
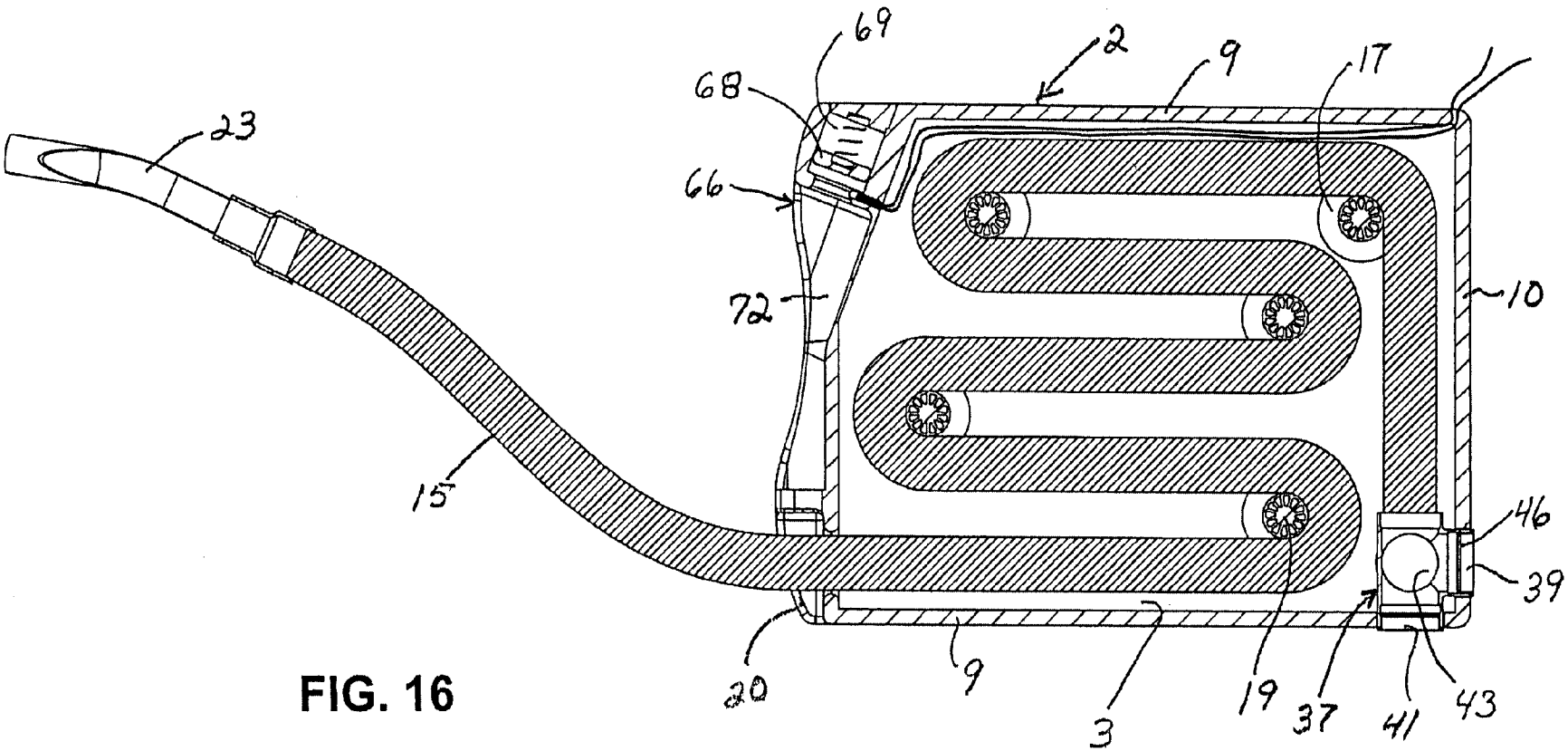
FIG. 16 is a diagrammatic cross-sectional view of a modified embodiment of the vacuum hose storage system of the present invention.

If desired, a special tube and hose connector 37 can be mounted in a lower rear corner of housing 2 (FIG. 16) and may have a plurality of outlets, such as outlet 39 in rear wall 10, a bottom outlet 41 in bottom wall 9 and a pair of opposed side wall outlets 43 formed in side walls 7. This provides other attachment locations for a section of tubing which is connected to the vacuum source depending upon the location of housing 2 within the larger outer storage cabinet 5, and the best location for the incoming vacuum supply tube. Any non-used tubing outlets as shown in FIG. 16 can easily be sealed by a cup-shaped seal 46 when not in use.

Figure 2:
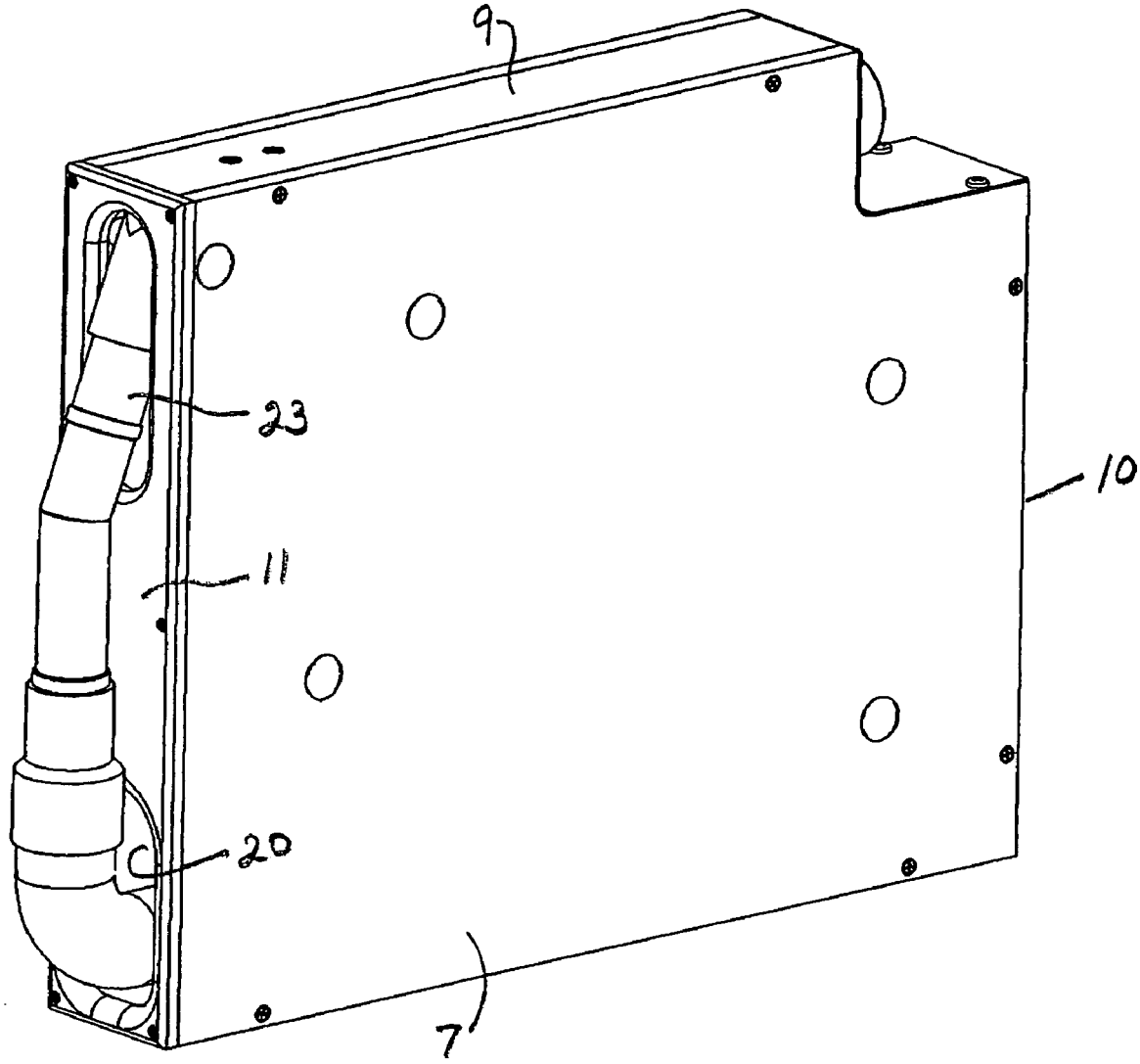
FIG. 2 is a side perspective view of the hose storage housing with the hose in a retracted position within the housing and the handle placed in the cradle.
Figure 4:
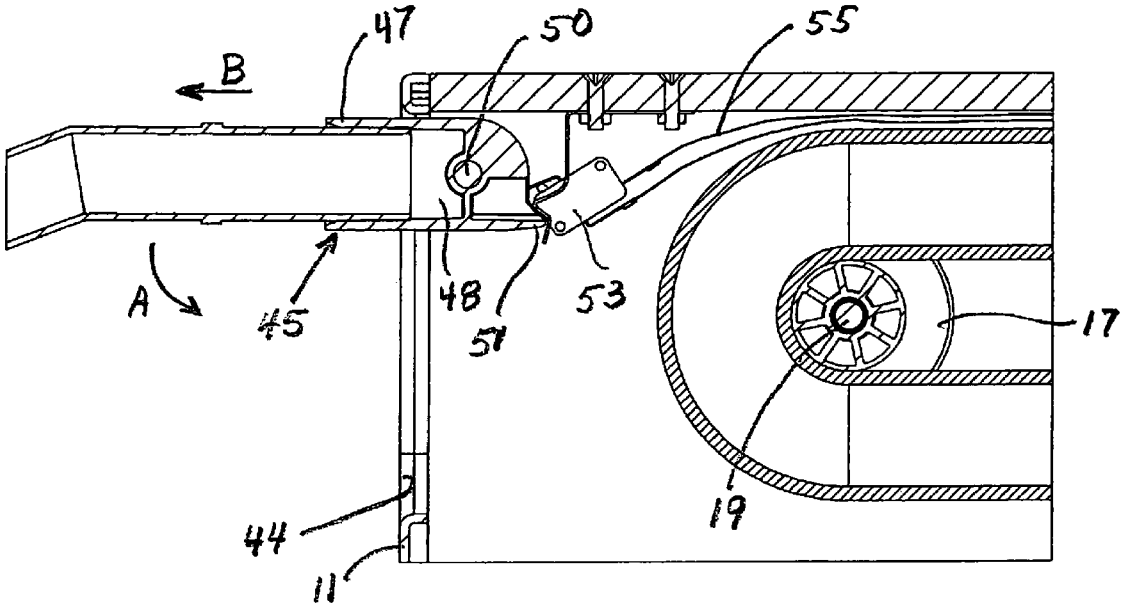
FIG. 4 is a fragmentary sectional view showing the hose placed in the supporting cradle in the power ON position.
Figure 5:
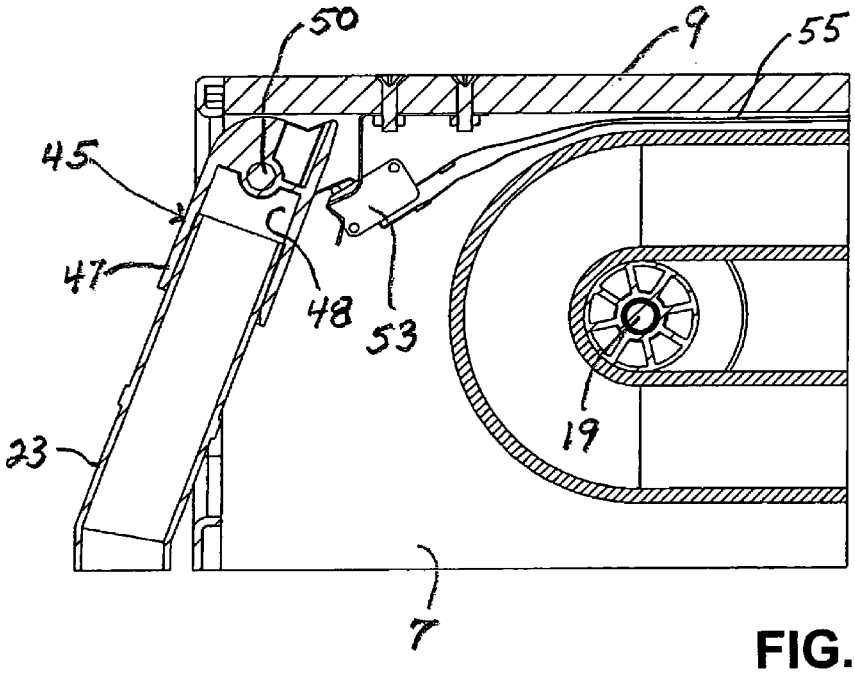
FIG. 5 is a fragmentary sectional view similar to FIG. 4 showing the hose supporting cradle in a power unit OFF condition.

In accordance with another feature of the invention, a hose receiving cradle 45 is located in front wall 11 of housing 2 and accessible through an opening 44 formed in front wall 11 (FIGS. 1 and 2). Cradle 45 includes a short section of tube 47 having a hollow interior 48 and is pivotally mounted by a pivot 50 between side walls 7 and is adapted to slidably receive handle 23 therein in a generally sliding frictional fit when the hose is not in use as shown in FIGS. 2 and 4. After insertion of the open end of handle 23 therein, the handle is pivoted downwardly as shown by Arrow A (FIG. 4) into the final stored position of FIG. 5. The inner end of cradle 45 is formed with a projection 51 which engages and actuates an ON/OFF switch 53 which is mounted closely adjacent thereto. This movement of cradle 45 from the ON position of FIG. 4 to the OFF position of FIG. 5 will turn the switch off. Switch 53 is connected to the vacuum power source by a plurality of electrical conductors 55. When handle 23 is in the storage position as shown in FIGS. 2 and 5, the switch is in the OFF position and when the user desires to use the vacuum system for a quick cleanup job, the user will merely grasp handle 23 and pivot it upwardly from the OFF position of FIG. 5 to the ON position of FIG. 4. This movement will automatically turn the vacuum source on, afterwhich the user merely slides the handle outwardly from the cradle as shown by Arrow B and then will pull outwardly on the hose in the direction of Arrow C, FIG. 3. This will start the hose to expand from its coiled condition to an expanded condition, as well as unwrapping it from around rollers 17.

Upon completion of a cleaning operation, the user will merely relax the pulling force on the hose wherein the expanded internal helical spring 21 of the hose will bias the hose toward a retracted coiled looped position around roller 17 until the handle 23 is replaced into cradle 45 in the position as shown in FIG. 4. The handle is then pivoted downwardly to the full storage position of FIG. 5 which will automatically shutoff the vacuum source by actuation of switch 53. Also, retraction of the hose back into the housing is assisted by the force of the vacuum exerted on the hose which also biases the hose towards a retracted position. However, neither of the biasing force exerted on the hose by helical spring 21 or the vacuum source, is sufficiently great to require a large force to be exerted on the hose by the user to move it from the collapsed retracted position to its extended position and to maintain it in the extended position during a cleaning operation. However, this biasing force does assist in retracting the hose into its coiled looped position after cleanup has been accomplished. Also, storage system 1 can use a neutrally or expansion biased hose if desired, which relies solely on the vacuum source for retraction of the hose back into the housing.

FIG. 8 shows a slightly modified form of the present invention in which one or more drive belts 62 and 63 may extend around adjacent pairs of rollers 17 to assist in the extension and retraction of the hose from and back into the housing. Upon initially pulling the hose from housing 2 in the direction of Arrow D (FIG. 8), the hose will immediately start to move about and rotate the lowermost roller 17A as shown by Arrow E. The next roller 17B begins to rotate shortly thereafter as the hose is stretched and starts to move about roller 17B as shown by Arrow F. This progresses to the next roller 17C and then to roller 17D in a slight time delay progression. By the use of drive belts 62 and 63, the initial rotation of roller 17A will automatically start roller 17C rotating almost simultaneously with the rotation of roller 17A. Likewise roller 17D will begin to rotate almost simultaneously upon the rotation of roller 17B due to its connection therewith by drive belt 62. The use of drive belts 62 and 63 will assist in starting movement of all of the sections of hose and their corresponding rollers almost at the same time to greatly facilitate the removal of the hose from within housing 2 instead of the delayed sequence which occurs as the hose is pulled from the housing without connecting belts 62 and 63. Likewise, upon the hose beginning to retract back into the housing without the use of the belts, roller 17A will begin to rotate followed shortly by the rotation of 17B, then roller 17C and finally roller 17D in a time delay sequence. The use of drive belts 62 and 63 will again enable the sections of hose and associated rollers to move more in unison assisting the retraction of the hose back into housing 2.

In accordance with another feature of the invention, one or more ratchet mechanisms 65 can be mounted on one or more of the rollers which when the hose is pulled from within housing 2 will prevent the rollers from having a tendency to rotate backwards since they are retained in their forward rotated position by the ratchet mechanism. This assists in reducing the biasing retraction force exerted on the hose by internal helical spring 21 and the internal vacuum. This reduces the fatigue on the user by not requiring the user to continually exert an outward force on the hose to prevent its retraction back into housing 2. The ratchet mechanism can be easily reduced by suddenly pulling out on the hose and then releasing this pulling force permitting the one or more rollers on which the ratchet mechanism are connected to rotate freely in the reverse direction. This type of ratchet mechanisms is well-known in the art such as used for vehicle seat belts and similar applications, and thus the details thereof are not described in further detail.

Figure 14:
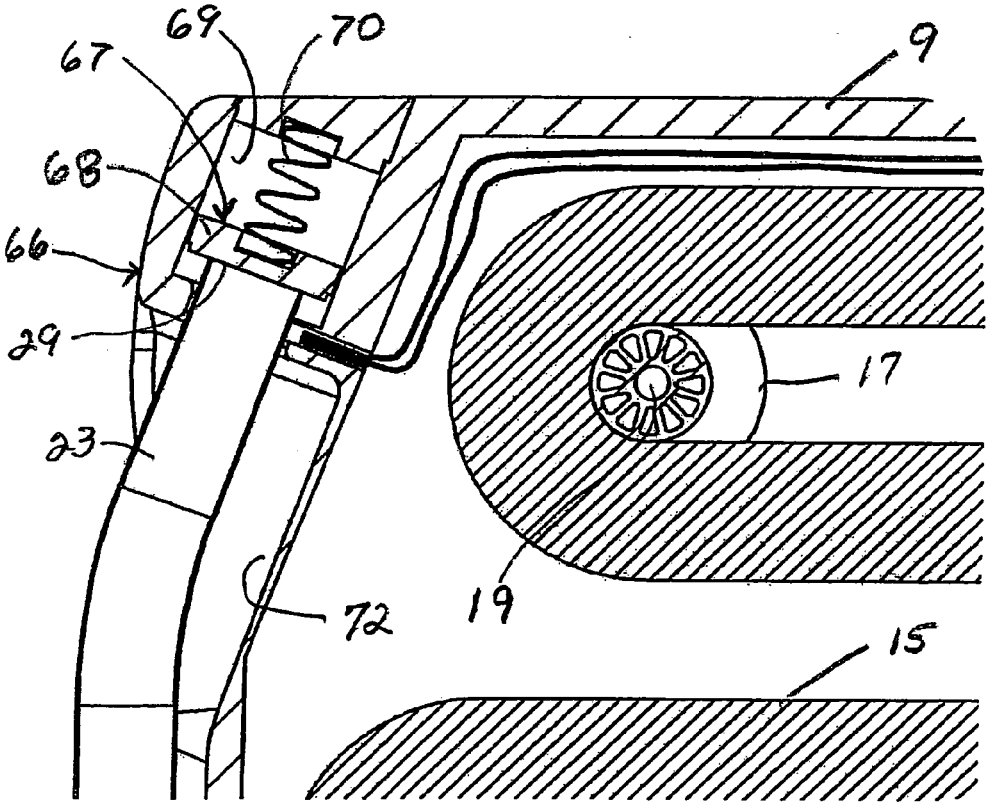
FIG. 14 is an enlarged fragmentary view showing the hose end in a stored position with a modified end sealing member engaged therewith.

A modified cradle 66 is shown in FIGS. 14 and 16 and includes a shutoff valve 67 indicated generally at 67. Shutoff valve 67 is mounted in a compartment 69 formed at the corner of front wall 11 and top wall 9 for storing handle 23 in a readily accessible position. Shutoff valve 67 includes a sealing plate 68 which is biased by a compression spring 70 toward open end 29 of handle 23 for automatically sealing open end 29 upon insertion of the handle end through a front wall opening 72. Sealing plate 68 preferably will be used when the vacuum producing source is the central vacuum cleaning unit 33 as shown in FIG. 7, which is connected to other outlets throughout the building. This enables unit 33 to be operative for use throughout the structure.

Figure 15:
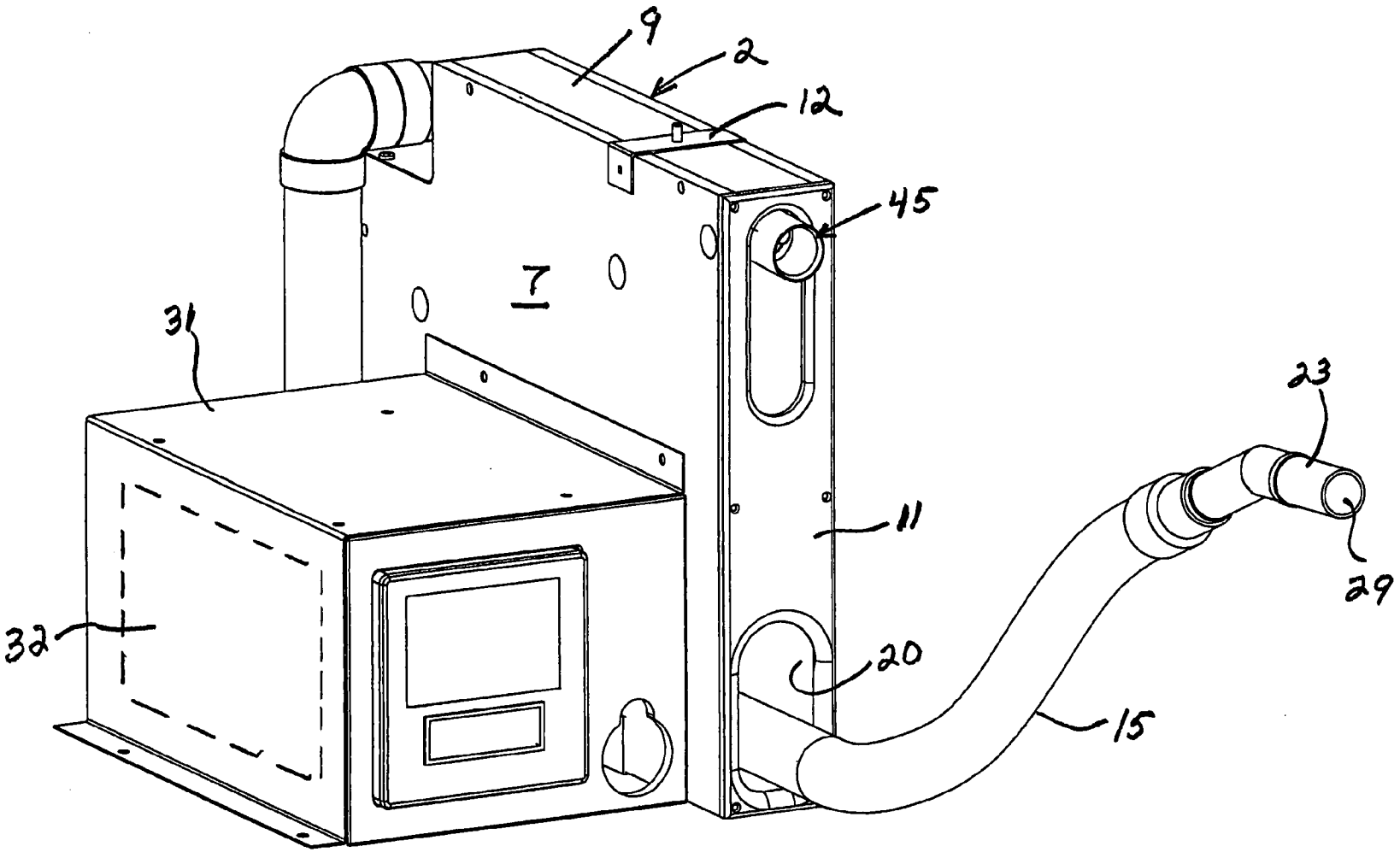
FIG. 15 is a perspective view of a vacuum power source mounted adjacent the storage housing of the type shown in FIG. 2.

An electrical ON/OFF switch 75 is mounted within or adjacent compartment 69 and connected to a source of electrical power by a pair of electrical conductors 77 for controlling a vacuum producing motor 32 such as shown in FIG. 15 or the motor of the central unit 33 as shown in FIG. 7. Switch 75 could be a plunger-type switch that is actuated automatically upon insertion of the end of handle 23 into compartment 69 or other type of switch without affecting the concept of the present invention. Likewise, sealing plate 68 can have other configuration than the spring biased seal as shown in the drawings and described above.

In accordance with another feature of the present invention discussed above is the attachment of a power driven rotary brush cleaning attachment 26 on the end of handle 23 by a wand 28 and connected to a remote source of high voltage electric power such as 120V/240V, by electrical conductors 73 which extend throughout the interior of cleaning hose 15. An ON/OFF switch 75 mounted on the wand 28 is used to control the operation of cleaning attachment 26. The cleaning attachment can be easily removed from the wand 28 by a connection clip 78 of the type well-known in the cleaning appliance industry. The cleaning wand 28 can then be easily detached from handle 23 after the cleaning operation has been completed.

In operation, housing 2 preferably is mounted within various types of an outer larger storage cabinet 5 or could be located in a closet or similar area and connected to a vacuum source, either an adjacent self-contained vacuum unit contains motor 32 (FIG. 15) or a remote central vacuum cleaning unit 33 (FIG. 7). Housing 2 can be placed vertically as shown in the drawings or horizontally without affecting its operation. The cleaning hose is operational immediately upon removing handle 23 from the cradle by automatically actuating switch 53 (FIG. 4) upon its upward pivotal movement or by actuating switch 75 (FIG. 14). Either type of vacuum unit will automatically turn on enabling the user to easily pull outwardly on the handle hose which will extend the hose from its collapsed position as shown in FIGS. 6 and 8 to an extended position as shown in FIGS. 3 and 7 as it unwinds about the spaced rollers 17. The user then pulls the hose to the needed length to reach the cleanup area and perform the desired cleanup. After the cleanup has been completed, the user merely releases the pulling force on the hose enabling internal spring 21 of hose 15 and the vacuum force to retract the hose into storage compartment 13 where it continues to collapse about the spaced rollers 17. As discussed above, the vacuum source created in the interior of the hose will also exert a retracting force on the hose, which in combination with the force exerted by spring 21, will permit the hose to be easily retracted automatically into storage compartment 13 about rollers 17. The user then inserts the end of the handle 23 into interior 48 of tube section 47 or into compartment 69 where open end 29 is automatically sealed by sealing plate 68, with switches 53 or 75 automatically being moved to the OFF position de-energizing self-contained motor 32 or remote vacuum unit 33.

The relatively small compact size of housing 2 and its ability to hold a considerable length of hose 15 and its automatic mode of operation will enable the user to easily remove the hose from its position within cradles 49 and 66 for cleaning up small spills or other dirt and debris in an adjacent area which heretofore required the homeowner to remove a length of hose from a storage area and connect it to an adjacent vacuum outlet valve. Heretofore, after picking up the dirt the user had to remove the hose from the wall mounted control valve and return it to its storage area. The collected dirt is drawn through hose 15 and deposited in a dirt receptacle contained in housing 31 (FIG. 7) or in the collection receptacle of central unit 33 (FIG. 7). It is also understood that housing 2 could easily be mounted freestanding in a work area, for example, adjacent a power saw for cleaning up sawdust or the like, could be located within a cabinet in an RV, boat or other vehicle where space is limited. Regardless of its location and mounting arrangement, it is able to store a relatively long length of hose to reach a considerable distance from the cabinet when in operation.

Storage system 1 enables an occupant to quickly pickup small quantities of dirt, spillage etc. by easily removing handle 23 from its storage cradle and directing open end 29 against the area being cleaned. Afterwhich hose 15 retracts automatically into housing 2 upon releasing the pulling force on the hose.

Figure 9:
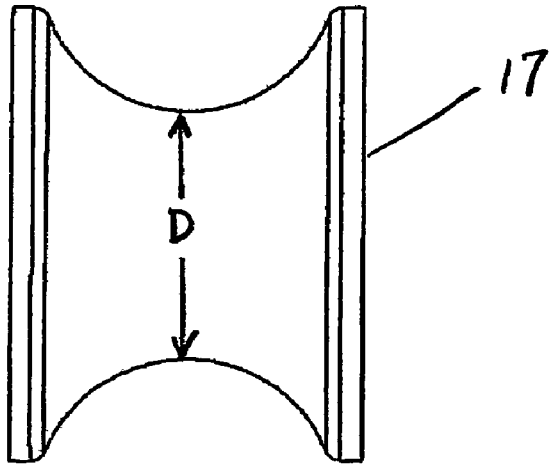
FIG. 9 is an elevational view of one of the guide rollers used for storing the hose within the housing.
Figure 10:
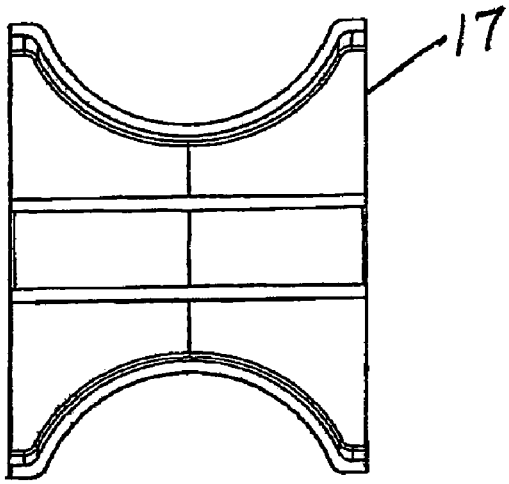
FIG. 10 is a sectional view through the center of the roller of FIG. 9.
Figure 11:
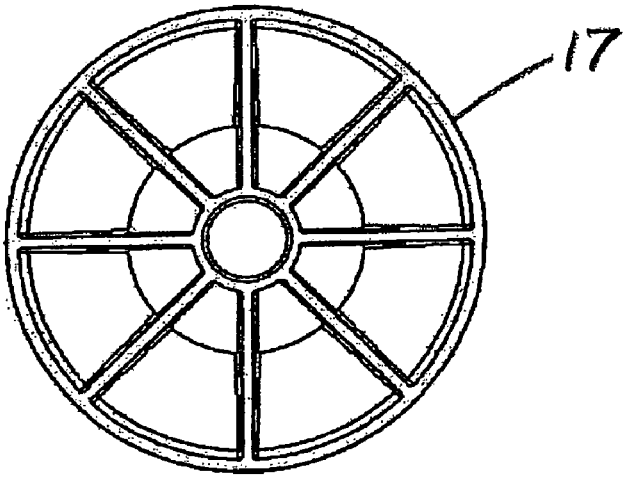
FIG. 11 is a side elevational view of the roller shown in FIG. 9.

In accordance with another feature, the total length of the hose for use in a particular size housing 2 can be determined easily by the following formula $L_{TOT}=\Sigma L+\frac{1}{2}W\pi D$ with reference to FIG. 6, wherein $L_{TOT}$ is the total length of the hose, $\Sigma L$ is the sum of the individual horizontal lengths between the center lines of the rollers indicated by $L_1$, $L_2$ etc., wherein W is the number of rollers, and D is the diameter of the rollers as shown in FIGS. 6 and 9.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A vacuum hose storage system comprising:

a housing forming an internal storage compartment;

a plurality of guide rollers mounted within the storage compartment;

a length of hose extendable from a retracted position in the storage compartment and an extended position extending from said storage compartment, said hose having a first end adapted to be connected to a vacuum source and an open second end for collecting dirt from an area to be cleaned, wherein a portion of said hose extends in a looped fashion about the guide rollers when in the retracted and extended positions;

a handle on the second end of the hose;

a cradle on the housing for holding the handle when the hose is in the retracted position; and a switch for turning the vacuum source ON and OFF when the handle is placed in the cradle.

2. The storage system defined in claim 1 including a biasing device connected to the hose for exerting a retracting force on the hose when in an extended position.

3. The storage system defined in claim 2 wherein the biasing device is a helical spring mounted within the hose.

4. The storage system defined in claim 1 wherein the cabinet includes at least a pair of opposed side walls and a pair of opposed end walls.

5. The storage system defined in claim 4 wherein an opening is formed in one of the end walls through which the hose extends from the storage compartment; and wherein the cradle is formed in the said one end wall.

6. The storage system defined in claim 1 wherein the guide rollers are rotatably mounted on at least one of the side walls of the housing.

7. The storage system defined in claim 6 wherein four guide rollers are mounted within the storage compartment in a spaced relationship whereby the hose extends in a looped fashion about said guide rollers and forms a plurality of loops.

8. The storage system defined in claim 1 wherein the vacuum source is a vacuum producing motor mounted in a second housing adjacent the hose storage housing.

9. The storage system defined in claim 1 wherein the vacuum source is a vacuum unit of a central vacuum cleaning system located remote from the housing.

10. The storage system defined in claim 1 including a seal which is in contact with the open end of the handle when said handle is placed in the cradle.

11. The storage system defined in claim 10 wherein the seal is spring biased toward the open second end of the hose.

12. The storage system defined in claim 1 wherein the hose has a 5 to 1 elongation factor between extended and retracted position.

13. The storage system defined in claim 1 wherein the guide rollers have a concave outer circumference; and in which said rollers are formed of a plastic material.

14. The storage system defined in claim 1 wherein at least one drive belt extends between a pair of the guide rollers.

15. The storage system defined in claim 14 wherein at least two drive belts extend between two pairs of guide rollers.

16. The storage system defined in claim 1 wherein at least four guide rollers are rotatably mounted in the storage compartment forming at least five vertically spaced horizontal lengths of hose.

17. The storage system defined in claim 16 wherein the total length of the hose is approximately equal to the sum of the number of horizontal lengths of the hose plus $\frac{1}{2}W\pi D$ where W is the number of rollers and D is the diameter of said rollers.

18. The storage system defined in claim 1 wherein the housing has a parallelepiped configuration with a front wall and a spaced rear wall; in which the cradle is accessible through a first opening formed in an upper portion of the front wall; and in which the hose extends through a second opening formed in a lower portion of said front wall.

19. The storage system defined in claim 1 wherein the switch is formed in the handle.

20. The storage system defined in claim 1 wherein electrical conductors are in the hose for connections to a high voltage source.

21. The storage system defined in claim 1 wherein the length of hose is a neutrally biased hose.

22. The storage system defined in claim 1 wherein the length of hose is an expansion biased hose.

23. The storage system defined in claim 1 wherein a releasable locking device cooperates with certain of the guide rollers to temporarily retain the rollers in a non-rotatable state.

* * * * *